US010807407B1

(12) United States Patent
Huynh

(10) Patent No.: US 10,807,407 B1
(45) Date of Patent: Oct. 20, 2020

(54) PAINT CONTAINER ASSEMBLY

(71) Applicant: Nhut Huynh, Savannah, GA (US)

(72) Inventor: Nhut Huynh, Savannah, GA (US)

( * ) Notice: Subject to any disclaimer, the term of this patent is extended or adjusted under 35 U.S.C. 154(b) by 21 days.

(21) Appl. No.: 16/245,005

(22) Filed: Jan. 10, 2019

(51) Int. Cl.
*B44D 3/12* (2006.01)
*E06C 7/14* (2006.01)

(52) U.S. Cl.
CPC ..... *B44D 3/121* (2013.01); *B44D 3/128* (2013.01); *B44D 3/126* (2013.01); *E06C 7/14* (2013.01)

(58) Field of Classification Search
CPC ..... B44D 3/121; B44D 3/128; B44D 3/126; B44D 3/12; B44D 3/123; B44D 3/125; B44D 3/14; B44D 3/16; E06C 7/14; E06C 7/146; B65D 21/0233; B65D 25/2852
USPC ..... 206/361; 220/736, 570, 697, 761, 763, 220/772, 776; 15/257.06, 257.05; 248/210, 238; 182/129, 130
See application file for complete search history.

(56) References Cited

U.S. PATENT DOCUMENTS 2,911,133 A * 11/1959 Ruggieri ..... E06C 7/14 182/129
2,932,838 A * 4/1960 Ouellette ..... B44D 3/125 15/257.06
2,988,767 A * 6/1961 Tretwold ..... B44D 3/126 15/257.06
3,493,988 A * 2/1970 Tidwell ..... B44D 3/126 15/257.06
3,536,285 A * 10/1970 Vaughn ..... B44D 3/123 248/309.4
3,729,158 A * 4/1973 Nagy ..... B44D 3/123 248/110
3,837,034 A * 9/1974 Leffert ..... B44D 3/123 15/257.06
4,101,046 A * 7/1978 Puntillo ..... B44D 3/123 220/697
4,205,411 A * 6/1980 Cupp ..... B44D 3/126 15/257.06
D303,304 S * 9/1989 Sabatino ..... D32/53.1
5,123,576 A 6/1992 Lawrence
5,402,910 A * 4/1995 Pilney ..... B44D 3/12 220/570
5,493,751 A * 2/1996 Misiukowiec ..... B44D 3/126 15/257.06
5,622,278 A * 4/1997 Fries ..... E06C 7/14 206/373

(Continued)

*Primary Examiner* — Gideon R Weinerth
(74) *Attorney, Agent, or Firm* — Sanchelima & Associates, P.A.; Christian Sanchelima; Jesus Sanchelima

(57) ABSTRACT

A container assembly or paint container assembly with an integral scraper and brush holder configured to hold a brush, wipe excess paint from the brush or bristles, and suspend the container assembly, is disclosed. The container assembly comprises a liquid holding portion, a scraper member, one or more brush holders, a first handle member, and a second handle member. The liquid holding portion comprises a rectangular base and at least four upright walls extend flaringly from the base. The scraper member comprises a plurality of ribs protruding from an inner side of at least one upright wall and the brush holders are disposed at an inner side of at least two upright walls. The first handle member hingedly attached to an upper portion of the opposing upright walls, and the second handle member extends from an opposite end of at least one upright wall, exteriorly.

7 Claims, 4 Drawing Sheets

(56) References Cited

U.S. PATENT DOCUMENTS

| | | | | |
|---|---|---|---|---|
| 5,641,142 | A * | 6/1997 | Hanson | E06C 7/14 248/238 |
| 5,799,819 | A * | 9/1998 | Nimer | B44D 3/14 220/481 |
| 5,865,409 | A * | 2/1999 | Nimer | E06C 7/14 220/570 |
| 6,929,225 | B1 * | 8/2005 | Kent | B44D 3/123 211/65 |
| 7,156,352 | B2 | 1/2007 | Cudney | |
| 7,410,074 | B1 * | 8/2008 | Brunning | B44D 3/126 15/257.06 |
| D607,624 | S * | 1/2010 | Bergman | D32/54 |
| 2006/0102424 | A1 * | 5/2006 | Wise | E06C 7/146 182/129 |
| 2006/0225959 | A1 * | 10/2006 | Pohl | B44D 3/126 182/129 |
| 2006/0255217 | A1 * | 11/2006 | Wise | E06C 7/146 248/153 |
| 2015/0053708 | A1 * | 2/2015 | Ruha | B44D 3/126 220/772 |
| 2018/0207976 | A1 * | 7/2018 | Robertson | B44D 3/126 |

* cited by examiner

PAINT CONTAINER ASSEMBLY

BACKGROUND OF THE INVENTION

1. Field of the Invention

The present disclosure relates to painting accessories. More particularly, the present disclosure relates to a paint container assembly with an integral scraper and brush holder.

2. Description of the Related Art

Many users prefer to paint directly from the paint container as they find it faster, safer, and more convenient. However, painting from the paint container creates a number of vexing problems. One problem is that holding the wire bail handle is uncomfortable, and may causes severe hand strain in a short amount of time. Another problem is, the container's wire bail handle naturally positions one of the user's hand directly over the top of the container's opening, creating an obstruction. This obstruction makes it difficult to insert paintbrushes and other tools into the opening. Yet another problem is that a paint container has no built-in provisions to allow it to hang from a ladder without any aid of an additional device. Yet another problem is, the container has no provisions to store multiple brushes, as in some cases; the painter may require more than one brush during painting.

Several devices have been designed in the past. None of them, however, include a container assembly that is capable of addressing the foregoing discussed issues.

Applicant believes that a related reference corresponds to U.S. Pat. No. 5,123,576 filed by Jonnay J. Lawrence describes a paint can accessory. The Jonnay reference discloses a tray with vertical sides. The tray comprises a large opening defined by a downwardly directed, tapered cylinder that seals into the top of a paint can. A support on the tray holds a paintbrush on edge. A support is also provided for a paint roller. The supports are arranged so that paint drains into the can and the handles are unsoiled. A device across the opening allows removal of excess paint. The tray may be used to distribute paint on the roller. The opening provides access to the paint, and the accessory locks in place so that open can with both roller and brush in place may be carried about as a unit. The accessory includes a pouring spout. However, the Jonnay reference lacks to provide a built-in provision to allow the paint can to hang from a ladder.

Another related reference is U.S. Pat. No. 7,156,352 filed by Dennis Cudney describes an accessory container attachment for a paint can. The Dennis reference discloses an accessory container attachment comprising an inexpensive plastic paint can caddy having a substantially rectangular container housing with multi-compartments adapted to fit securely to a paint can. The substantially rectangular container housing having one side thereof curved to conform to the curvature of the paint can, and attached thereto is a detachable strap member used in combination with a slot extending downwardly in the curved side for detachably securing the housing to a paint can. A plurality of various-shaped extrusions may be moulded into compartments on the side walls of the housing to hold accessories such as a paintbrush, paint can top, small and tools, measuring tape and the like. However, the Dennis reference also lacks to provide a built-in provision to allow the paint can to hang from a ladder. Further, the Dennis reference discloses a bulk and complicated accessory construction, which is difficult to set up with the existing paint can.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a container assembly or paint container assembly with an integral scraper configured for removing excess paint from a paintbrush.

It is another object of the present invention to provide a container assembly with an integral holder for magnetically holding a paintbrush or paint scraper.

It is yet another object of the present invention to provide a container assembly with a handle assembly for securely holding and lifting the container.

It is yet another object of the present invention to provide a container assembly with a handle assembly to hang the container assembly on a ladder, easel, or the like.

It is yet another object of the present invention to provide a container assembly, which is of one-piece construction and relatively simple to manufacture and effective in use.

It is yet another object of the present invention to provide a container assembly comprising a liquid holding portion or receptacle member having a rectangular base and at least four upright walls extending flaringly from the base.

It is yet another object of the present invention to provide a container assembly comprising a scraper member comprising a plurality of ribs protruding from an inner side of at least one upright wall.

It is yet another object of the present invention to provide a container assembly comprising one or more brush holders disposed at an inner side of at least two upright walls.

It is yet another object of the present invention to provide a container assembly comprising a first handle member hingedly attached to an upper portion of the opposing upright walls, and a second handle member extends from opposite ends of at least one upright wall, exteriorly.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
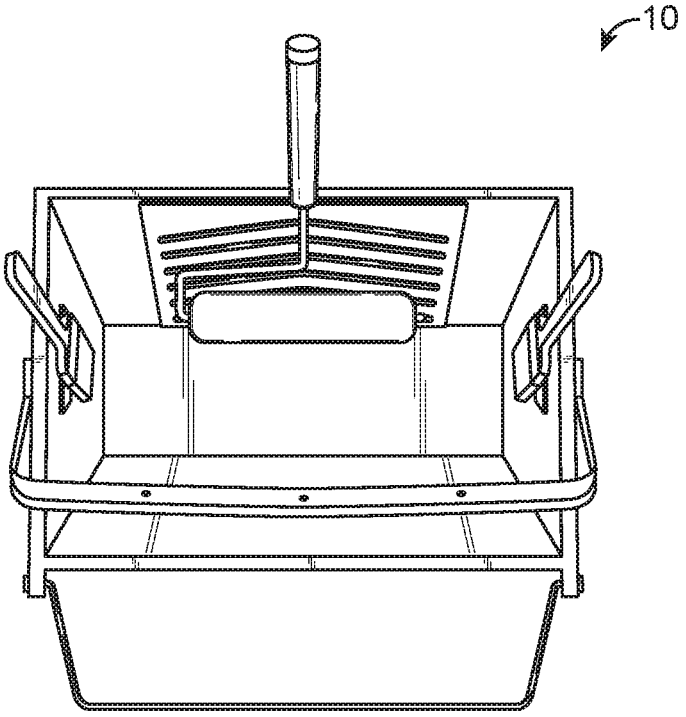
FIG. 1 exemplarily illustrates a container assembly 10 with integral scraper configured for wiping excess paint from a paintbrush and holder for securing the paintbrush in an embodiment of the present invention.
Figure 2:
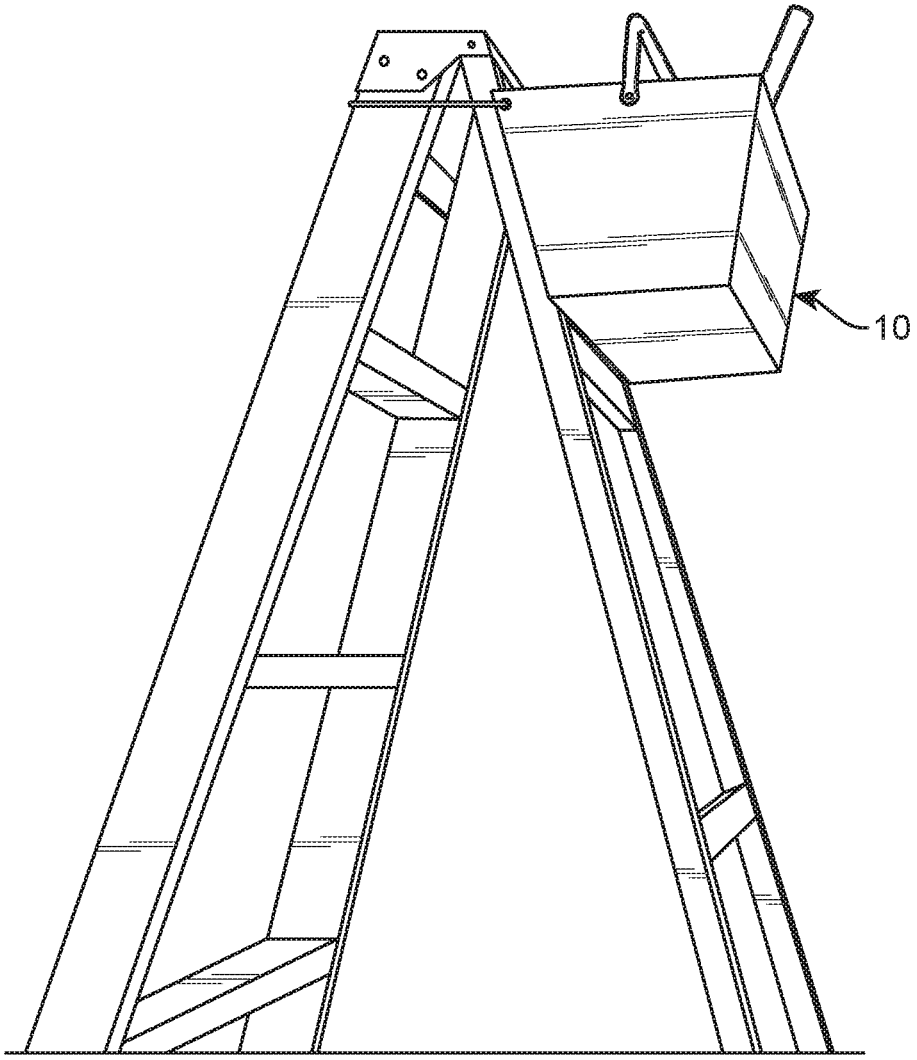
FIG. 2 exemplarily illustrates the container assembly 10 secured at an upper portion of a ladder in an embodiment of the present invention.
Figure 3:
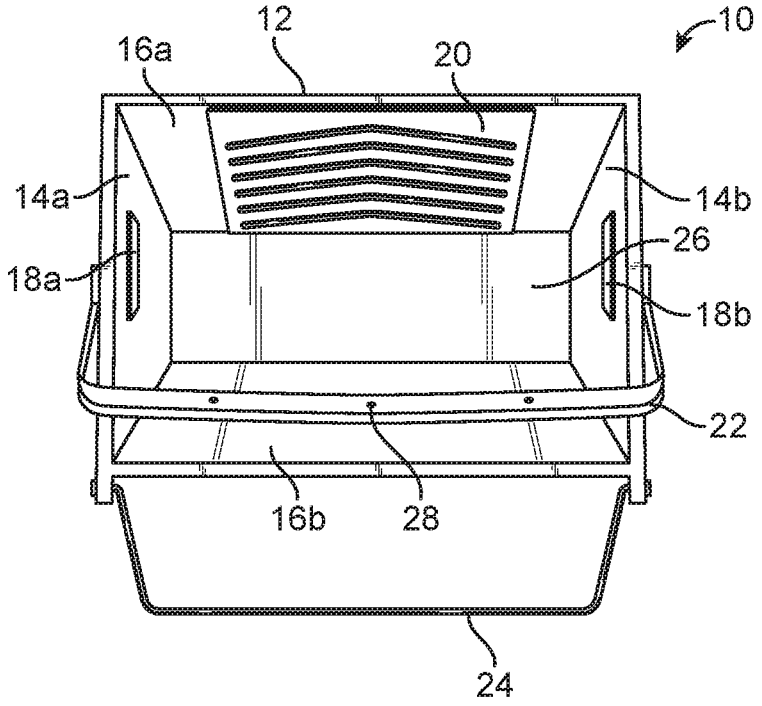
FIG. 3 exemplarily illustrates a top view of the container assembly 10 in an embodiment of the present invention. The container assembly 10 comprising a receptacle member 12, a scraper member 20, one or more brush holders (18*a*, 18*b*), a first handle member 22 and a second handle member 24, is illustrated.
Figure 4:
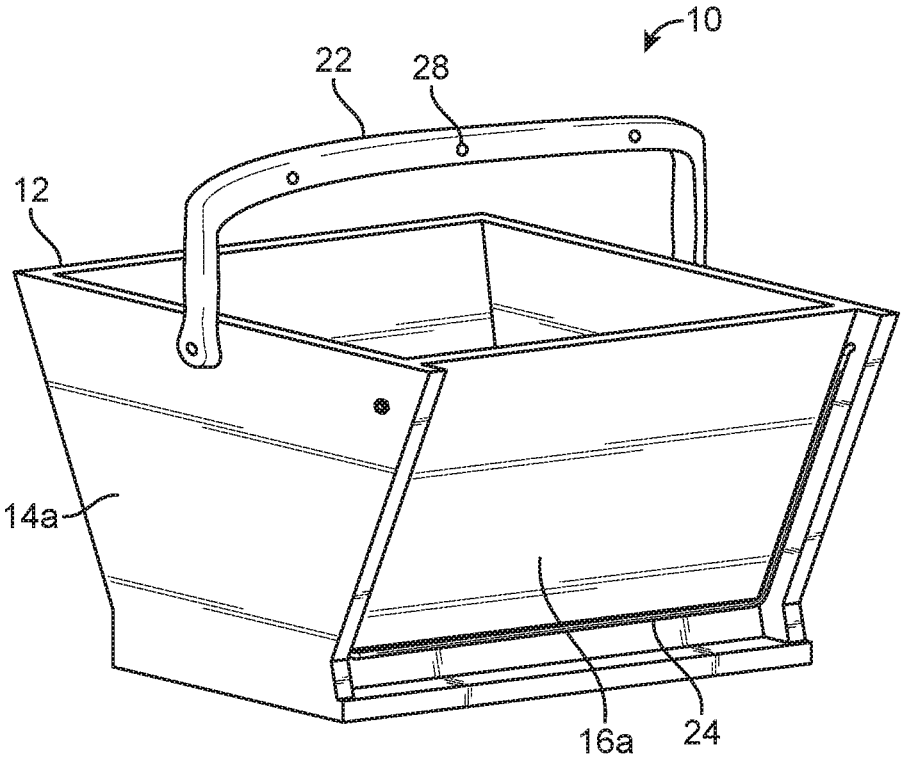
FIG. 4 exemplarily illustrates a perspective view of the container assembly 10 in an embodiment of the present invention. The receptacle member 12 comprising a rectangular base and at least four upright walls extend flaringly from the base, is illustrated.
Figure 5:
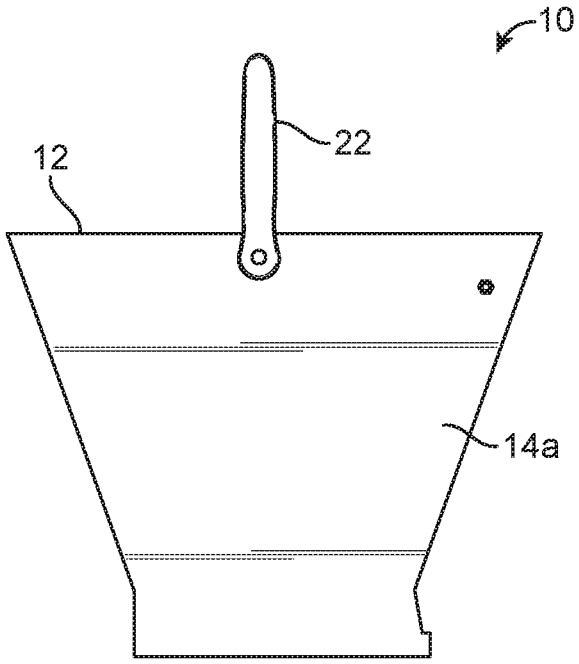
FIG. 5 exemplarily illustrates a side view of the container assembly 10 in an embodiment of the present invention.

Referring now to the drawings, FIGS. 1-5, where the present invention is generally referred with numeral 10, it can be observed that a container assembly or a paint container assembly 10 with an integral scraper, handle and brush holder, is disclosed. The container assembly 10 is configured to hold a brush, wipe excess paint from the brush or bristles, and suspend the container assembly 10 on a hanger, ladder, nail, etc.

The container assembly 10 comprises a receptacle member or a liquid holding portion 12, a scraper member 20, one or more brush holders (18*a*, 18*b*). The receptacle member 12 comprises a rectangular base 26 and at least four upright walls extending flaringly from the base 26. The scraper member 20 comprises a plurality of ribs protruding from an inner side of at least one upright wall. The plurality of ribs enables to clean or wipe excess paint from a paintbrush or bristles.

The brush holders (18*a*, 18*b*) are adapted to securely hold one or more brushes. In one embodiment, each brush holder (18*a*, 18*b*) comprises at least one magnetic area. The magnetic area is configured to magnetically hold the paintbrush or paint scraper. In one embodiment, the at least one magnetic area is comprised of a single magnet or multiple magnets of strength or orientation sufficient to hold the paintbrush, wire brush, or paint scraper. The brush holders (18*a*, 18*b*) are configured to hold the paint brush by the handle with the bristles draining directly into the receptacle member 12.

The magnets in magnetic areas are attached to brush holders (18*a*, 18*b*) portion in any suitable way to secure the magnets to the holding portion, including stamped sheet metal, fasteners, welding or glue. In another embodiment, the brush holders (18*a*, 18*b*) portion is molded to secure the magnets (i.e., tabs, compression fit, etc.). In yet another embodiment, the brush holders (18*a*, 18*b*) portion is formed with magnets secured inside. In yet another embodiment, the magnets could comprise any suitable pattern. In yet another embodiment, the magnet includes, but not limited to, strong neodymium magnets and hard ferrite ceramic magnets. The disclosure and claims extend to any type of magnet with sufficient strength and orientation to hold the paintbrush or paint scraper securely to the holding portion.

In another embodiment, the brush holder (18*a*, 18*b*) could be a hook, jaws, fingers or an accurate cut-away portion to retain the paintbrush. In one embodiment, the at least four upright walls comprise a pair of side walls (14*a*, 14*b*), a front wall 16*a* and a rear wall 16*b*. In one embodiment, the container assembly 10 further comprises a handle assembly. The handle assembly comprises a first handle member 22 and a second handle member 24. In one embodiment, the first handle member 22 pivotally extends from an upper portion of the opposing rear 16*b* and front walls 16*a*. In another embodiment, the first handle member 22 comprises a plurality of apertures 28. The container assembly 10 could be hung on a hanger, hook, nail or the like, utilizing the plurality of apertures 28.

In one embodiment, the front wall 16*a* extends outwards to form a depression. The second handle member 24 extends from opposite extended ends of the front wall 16*a*, exteriorly. In one embodiment, the second handle member 24 comprises a characteristic shape to conform onto an upper end of the ladder, thereby holding the container assembly 10 in position without any support. The second handle member 24 is adapted to secure within the depression.

In one embodiment, the container assembly 10 is made of a material including, but not limited to, aluminum, plastic, rubber, stainless steel and any combination thereof. In another embodiment, the container assembly 10 is made of stainless steel. In yet another embodiment, the container assembly 10 is made of plastic. In yet another embodiment, the container assembly 10 is made of polymer. In yet another embodiment, the container assembly 10 could be manufactured in any color. In yet another embodiment, the container assembly 10 could be manufactured in any size. Further, the shape, diameter, area, color, material, density of the container assembly 10 may vary based on the preference of manufacturer or end user.

Advantageously, the present invention holds a wet brush with bristles dependent and draining into the open container assembly 10. The present invention further enables to wipe excess liquid from the bristles, wherein said liquid also drains into the open container assembly 10. The handle assembly of the present invention is to designed to suspend the container assembly 10 from the rung of the ladder in such a way that the hanger and the bucket are out of the way to avoid accidental spillage and to permit full use of the ladder.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A container assembly, comprising:

a receptacle member having a rectangular base and at least four upright walls extending flaringly from the base, said at least four upright walls including a front wall, a rear wall, and two sidewalls, wherein said rear wall and said two sidewalls are entirely flat, wherein said front wall includes a three sided perimeter frame extending outwardly therefrom, wherein said front wall is recessed toward an interior space of said receptacle member and away from said three sided perimeter frame thereby forming a rectangular depression on said front wall, wherein said three sided perimeter frame extends along a bottom end and sides of said front wall, wherein said rectangular depression is adapted to receive front side rails of a ladder;

a scraper member comprising a plurality of ribs protruding from an inner side of at least one upright wall;

one or more brush holders disposed at an inner side of at least two upright walls; and a handle member mounted to a distal end of inner sidewalls of said three sided perimeter frame, wherein said handle member is adapted to be rotated over a top cap of said ladder.

2. The container assembly of claim 1, wherein each brush holder comprises at least one magnet configured to hold a paintbrush by magnetic attraction.

3. The container assembly of claim 1, further comprises a top handle member which extends from opposite ends of at least one sidewall, exteriorly.

4. The container assembly of claim 3, wherein the top handle member comprises a plurality of apertures.

5. The container assembly of claim 1, wherein the handle member is adapted to secure within the depression.

6. The container assembly of claim 1, wherein said at least four upright walls each have an identical height.

7. A container assembly, comprising:

a ladder having a top cap and front side rails:

a receptacle member having a rectangular base and at least four upright walls extending flaringly from the base, said at least four upright walls including a front wall, a rear wall, and two sidewalls, wherein said rear wall and said two sidewalls are entirely flat, wherein said front wall includes a three sided perimeter frame extending outwardly therefrom, wherein said front wall is recessed toward an interior space of said receptacle member and away from said three sided perimeter frame thereby forming a rectangular depression on said front wall, wherein said three sided perimeter frame extends along a bottom end and sides of said front wall, wherein said rectangular depression is adapted to receive said front side rails of said ladder;

a scraper member comprising a plurality of ribs mounted to an inner side of said rear wall two brush holders disposed at an inner side of said two sidewalls wherein each brush holder comprises at least one magnet, two paint brushes to be mounted onto said two brush holders through a magnetic attraction;

a first handle member hingedly attached to an upper portion of said two sidewalls the opposing upright walls, said first handle mounted to outer sides of said two sidewalls, said first handle member extending over a top end of said receptacle member, wherein said first handle member includes a plurality of apertures adapted to receive a hanger or a hook; and a second handle member mounted to a distal edge of inner sidewalls of said three sided perimeter frame, wherein said handle member is rotated over said top cap of said ladder.

* * * * *